US008240475B2

(12) United States Patent
Loce et al.

(10) Patent No.: US 8,240,475 B2
(45) Date of Patent: Aug. 14, 2012

(54) COLOR FLICKER BOXES

(75) Inventors: Robert P. Loce, Webster, NY (US); Barry G. Gombert, Rochester, NY (US); Raja Bala, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 259 days.

(21) Appl. No.: 12/815,512

(22) Filed: Jun. 15, 2010

(65) Prior Publication Data

US 2011/0303571 A1 Dec. 15, 2011

(51) Int. Cl.
*B65D 73/00* (2006.01)

(52) U.S. Cl. ..... 206/457; 206/459.1

(58) Field of Classification Search ..... 206/769, 206/770, 459.1, 459.5, 457, 807
See application file for complete search history.

(56) References Cited

U.S. PATENT DOCUMENTS 5,103,979 A * 4/1992 Hustad ..... 206/459.1
5,525,383 A * 6/1996 Witkowski ..... 428/30
5,790,703 A 8/1998 Wang
6,252,971 B1 6/2001 Wang
6,263,086 B1 7/2001 Wang
6,731,409 B2 5/2004 Wang
7,197,161 B2 3/2007 Fan
7,436,977 B2 10/2008 Wang et al.
7,806,296 B2 * 10/2010 Connors ..... 222/78
8,025,442 B2 * 9/2011 Paulin ..... 383/106
2003/0168372 A1 * 9/2003 Headen et al. ..... 206/459.1
2007/0166490 A1 * 7/2007 Dey et al. ..... 428/35.7
2009/0014350 A1 * 1/2009 Gaumont ..... 206/528
2010/0025278 A1 * 2/2010 Tilton ..... 206/459.5
2011/0192752 A1 * 8/2011 Jimenez et al. ..... 206/459.5

* cited by examiner

*Primary Examiner* — Jacob K Ackun
(74) *Attorney, Agent, or Firm* — Fay Sharpe LLP

(57) ABSTRACT

Systems and methods are described that facilitate generating a color interference effect during opening and closing of a package for a product. The package includes first and second portions, each having printed thereon a color interference pattern. All or part of the second package portion is transparent, permitting the color interference pattern on the first package portion to be seen through the second package portion. The package portions are mated together (e.g., in a tube and sleeve arrangement or the like), such that the color interference patterns are aligned and overlap each other completely when the package is closed. As the package is opened (or closed), the interference patterns move or slide past each other, creating the visible color interference effect.

20 Claims, 8 Drawing Sheets

COLOR FLICKER BOXES

BACKGROUND

The subject application relates to visually interactive packaging systems and methods. While the systems and methods described herein relate to visually interactive packaging and the like, it will be appreciated that the described techniques may find application in other packaging systems, other visual effect applications, and/or packaging methods.

Scanimation systems have been used to produce moving patterns that create a visual effect or illusion when an overlay is moved past another pattern. For example a pattern of intermittent lines and/or dots representing an image in various positions is printed on a first surface (e.g., a page), and an overlay comprising a complementary pattern of dots and/or lines is then moved over the printed pattern to create an illusion that the subject of the printed image is changing position (e.g., an animal running, a word appearing and disappearing, etc.) That is, as lines in the overlay pattern align with lines in the printed pattern, the image subject appears to be in a first position. As the overlay pattern is moved slightly, the overlay pattern lines align in a new orientation relative to the printed pattern to make the image subject appear to be in a second position, and so on. The lines of the printed pattern and overlay pattern are sufficiently close together to make the motion of the image subject appear fluid and seamless. The art of producing moiré patterns and moving moiré patterns for visual consumption is well known. Moving moiré can be found in books and postcards. Novel and interesting packaging can help sell products, so there is always a need to develop packaging that will grab the attention of shoppers.

Accordingly, there is an unmet need for systems and/or methods that create moving visual interference effects via the act of opening a package, and the like. In the rest of the disclosure and claims, the term "interference effect" encompasses high frequency effects (e.g. moiré), smoothly varying effects, and combinations thereof.

BRIEF DESCRIPTION

In accordance with various aspects described herein, systems and methods are described that facilitate generating a color interference effect during opening and closing of a package using overlapping a slidable interference patterns (e.g., lines or patterns). For example, a package that generates a moving color interference effect during opening or closing comprises a first package portion with a first interfering region on an outer surface thereof, the interfering region having a first interference pattern printed thereon, and a transparent second package portion with a second interfering region having a second interference pattern printed thereon. The first and second interfering regions are aligned when the package is closed and are slidable past each other during opening and closing of the package, thereby creating the moving color interference effect. At least one of the first and second interference patterns comprises one or more non-neutral hues.

According to another aspect, a method of generating a visible moving color interference effect during opening and closing of a package comprises defining a first interfering region on a first package portion, and defining a second interfering region on a second package portion that is mated with the first package portion to form the package. The method further comprises applying a first interference pattern to the first interfering region, and applying a second interference pattern to the second interference region. The second package portion is mated to the first package portion to form the package. The first and second interference regions are aligned and overlapping when the package is in a closed state, and are slidable relative to each other and create an interference effect when the interfering regions slide past each other during opening or closing of the package. At least one of the first and second interference patterns comprises one or more non-neutral hues.

DETAILED DESCRIPTION

In accordance with various features described herein, systems and methods are described that provide a package that opens in a manner that creates dynamic visual effects through the use of moving color interference patterns. According to one aspect, the package is constructed of an inner body and a transparent (e.g., fully transparent, semi-transparent, translucent, etc.) outer body (e.g., a sleeve) such that the outer body slides off of the inner body to open the package. In one embodiment of the herein-described packages, systems and/or methods, all or a portion of the outer body is transparent (i.e., 95% light-transmissive or more), and may comprise a transparency material such as is used in printing devices to generate "transparencies" for display using an overhead projector or the like. The inner body has a printed color pattern on its outer surface and the outer body has compatible or complementary interfering color pattern printed on one or both of its surfaces. As the outer body is slid off the inner body, the color interference pattern changes due to the change in relative positions of the printed color patterns, created a visually detectable event. According to various aspects, the shifting color interference patterns could be smoothly-varying color patterns, patterns of high frequency and high contrast, and combinations thereof.

As used herein, a "neutral" hue denotes a black, white or gray hue, and a "non-neutral" hue denotes color.

Figure 1:
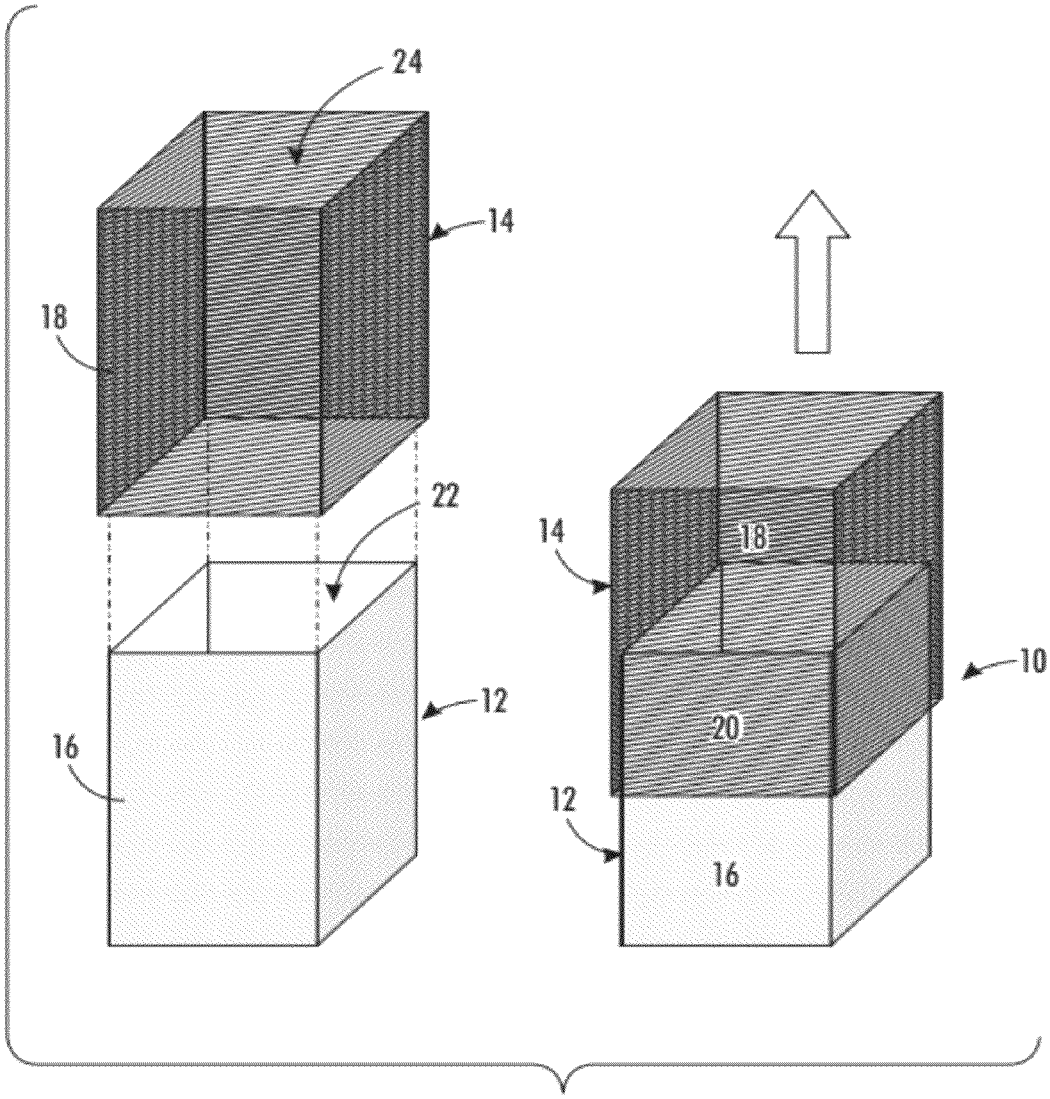
FIG. 1 illustrates an example of a package that opens in a manner that creates a dynamic visual effect via moving color interference patterns.

FIG. 1 illustrates an example of a package 10 that opens in a manner that creates a dynamic visual effect (e.g., a "flicker") via moving color interference patterns. The package 10 is constructed of an inner body 12 and transparent (e.g., fully transparent, semi-transparent, translucent, etc.) outer body 14 (e.g., a sleeve), such that the outer body 14 is slid off the inner body 12 to open the package 10. The inner body 12 has a printed color pattern 16 on at least a portion of its outer surface, and the outer body 14 has a compatible or complementary interfering color pattern 18 printed on one or both of its surfaces. As the outer body is slid or pulled off of the inner body, an interactive color interference pattern 20 changes due to the change in relative positions of respective printed color patterns 16, 18 with respect to each other. More generally stated, at least a portion of the outer body 14 is transparent (e.g., 95% light-transmissive or better) and is marked with an interfering printed color pattern 18, and at least that portion of the outer body is slid past a compatible or complementary interfering color pattern 16 printed on the inner body 12. The top 22 of the inner body is open (e.g., the inner body is 5-sided in this example), and the outer body serves as a lid for the inner body when the two bodies are mated in a closed position (e.g., the outer body is also 5-sided). Additionally, the top 24 of the outer body may be made transparent to permit a user to view the contents of the package 10. The interfering color patterns comprise a smoothly-varying color pattern possibly in combination with interference patterns of high frequency and contrast.

When the transparent outer body is slid off of the inner body to open the package or box, the sides of the box display smoothly-varying and changing color patterns, as shown in FIG. 1. Fewer than all of the sides, and/or less than all of the area of a given side of the inner or outer body need be printed with an interfering color pattern to fall within the scope of the various embodiments described herein. For example, one or more regions of one or more sides may contain text, logos, or graphics associated with the product housed in the box or package.

According to an example, the outer surface of the inner body and the inner and/or outer surface of the outer body are printed using a DC8000 device manufactured by XEROX™ or the like. Additionally or alternatively, die lines used to generate the interference patterns on the inner and/or outer bodies are cut on a plotter-cutter device manufactured by Graphtec or the like.

Figure 2:
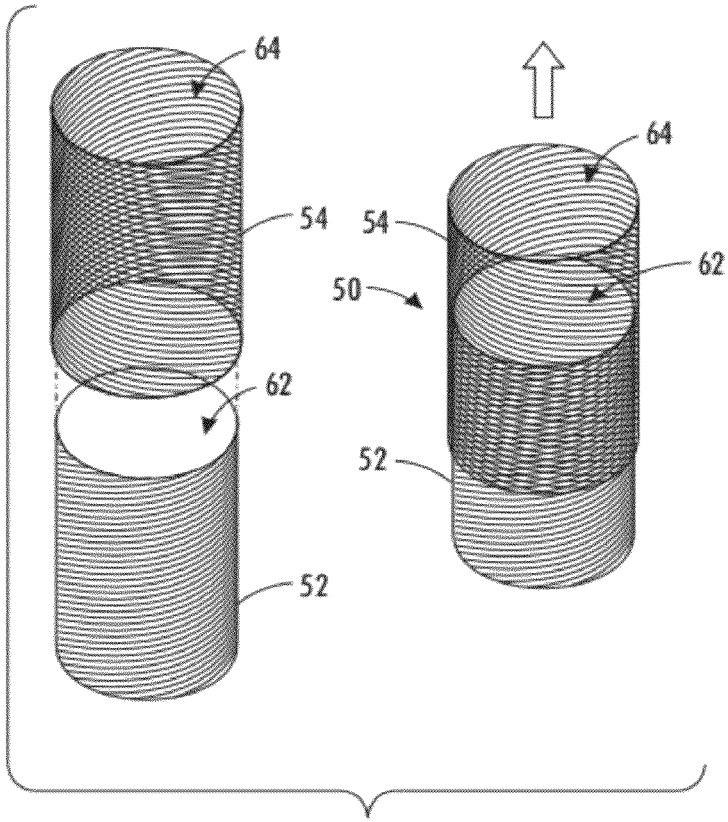
FIG. 2 illustrates an example of a tubular or cylindrical package that opens in a manner that creates a dynamic visual effect via color moving interference patterns.

FIG. 2 illustrates an example of a tubular or cylindrical package 50 that opens in a manner that creates a dynamic visual effect via moving color interference patterns. The package 50 includes an inner body 54 and a transparent (e.g., fully transparent, semi-transparent, translucent, etc.) outer body 54 (e.g., a sleeve), such that the outer body 54 is slid off the inner body 52 to open the package 50. The inner body 52 has a printed color pattern 56 on at least a portion of its outer surface, and the outer body 54 has a compatible or complementary interfering color pattern 58 printed on one or both of its surfaces. As the outer body is slid or pulled off of the inner body, an interactive color interference pattern 60 changes due to the change in relative positions of respective printed patterns 56, 58 with respect to each other. More generally stated, at least a portion of the outer body 54 is transparent or semi-transparent (e.g., 95% light-transmissive or more) and is marked with an interfering printed color pattern 58, and at least that portion of the outer body is slid past a compatible or complementary interfering color pattern 56 printed on the inner body 52. The top 62 of the inner body is open, and the outer body 54 serves as a lid for the inner body 52 when the two bodies are mated together in a closed position. Additionally, the top 64 of the outer body may be made transparent to permit a user to view the contents of the package 50. The interfering color patterns comprise smoothly-varying color patterns possibly in combination with interference patterns of high-frequency and high contrast.

Figure 3:
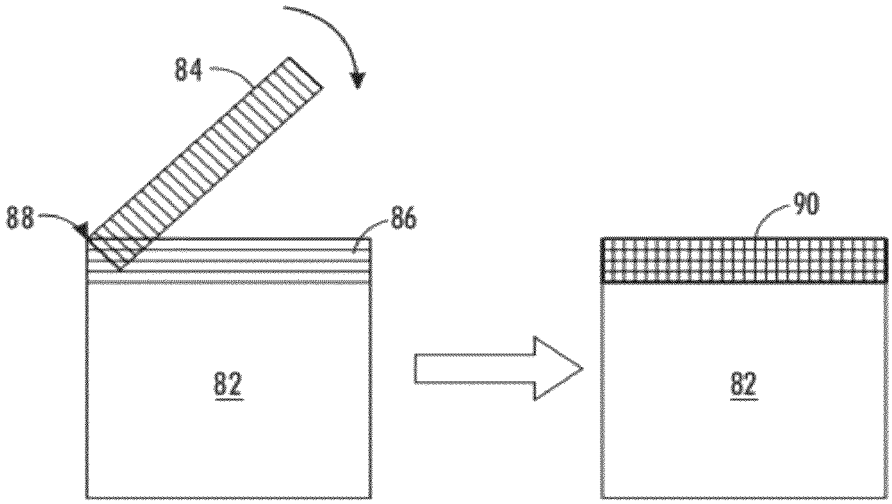
FIG. 3 illustrates an example of a package or box comprising a body or main portion in which an item is placed, and a lid portion that fits over a top of the body.

FIG. 3 illustrates an example of a package or box 80 comprising a body 82 or main portion in which an item is placed, and a lid portion 84 that fits over a top of the body 82. The body 82 includes an upper region 86 that includes an interfering color pattern. In one embodiment, the lid 84 (or sides thereof) is transparent, and the sides of the lid that overlap the body 82 when in a closed position include a complementary interfering color pattern that interacts with the interfering color pattern on the upper region 86 of the body 82 to produce a visual effect during opening and closing of the lid.

Figure 4:
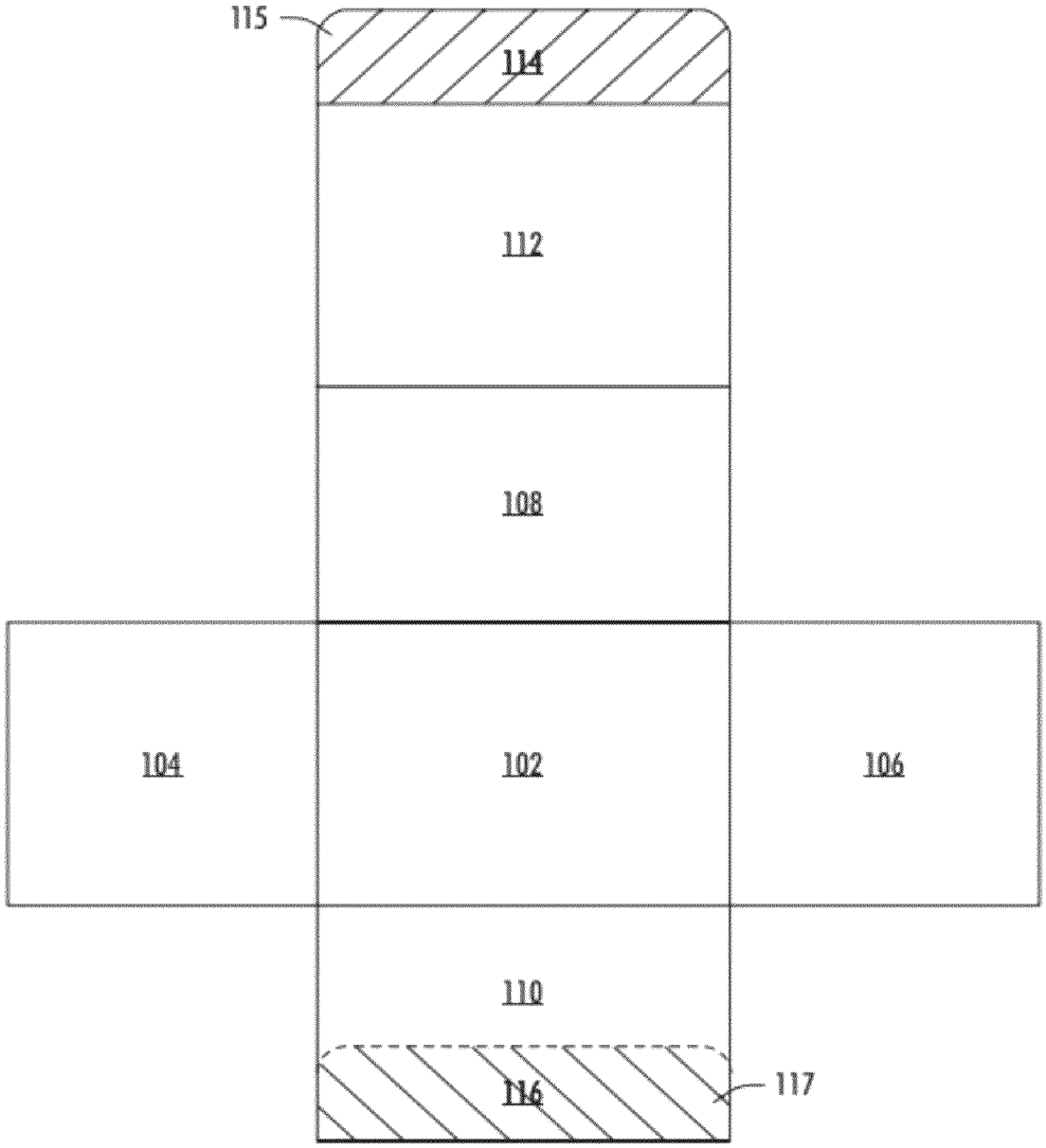
FIG. 4 illustrates an example of a box pattern that can be employed in conjunction with the various systems and methods described herein.

FIG. 4 illustrates an example of a box pattern 100 that can be employed in conjunction with the various systems and methods described herein. The box pattern 100 includes a bottom panel 102, a first side panel 104, a second side panel 106, a third side panel 108, and a fourth side panel 110. The third side is further coupled to a top side 112, which in turn is coupled to a flap 114 that tucks into the box top close the box when assembled. The flap 114 includes a color interference pattern 115. The fourth side panel 110 includes a complementary region 116 that includes corresponding or complementary color interference patterns 117. The complementary region 116 may be transparent or translucent in accordance with various aspects, to permit the interference pattern 115 on the flap 114 to show through, in order to generate a visible color interference effect during opening and closing of the box. It will be appreciated that any suitable box or box pattern may be used in conjunction with the various systems and methods described herein. A number of such suitable box patterns are defined according to the European Carton Maker's Association (ECMA).

Figure 5:
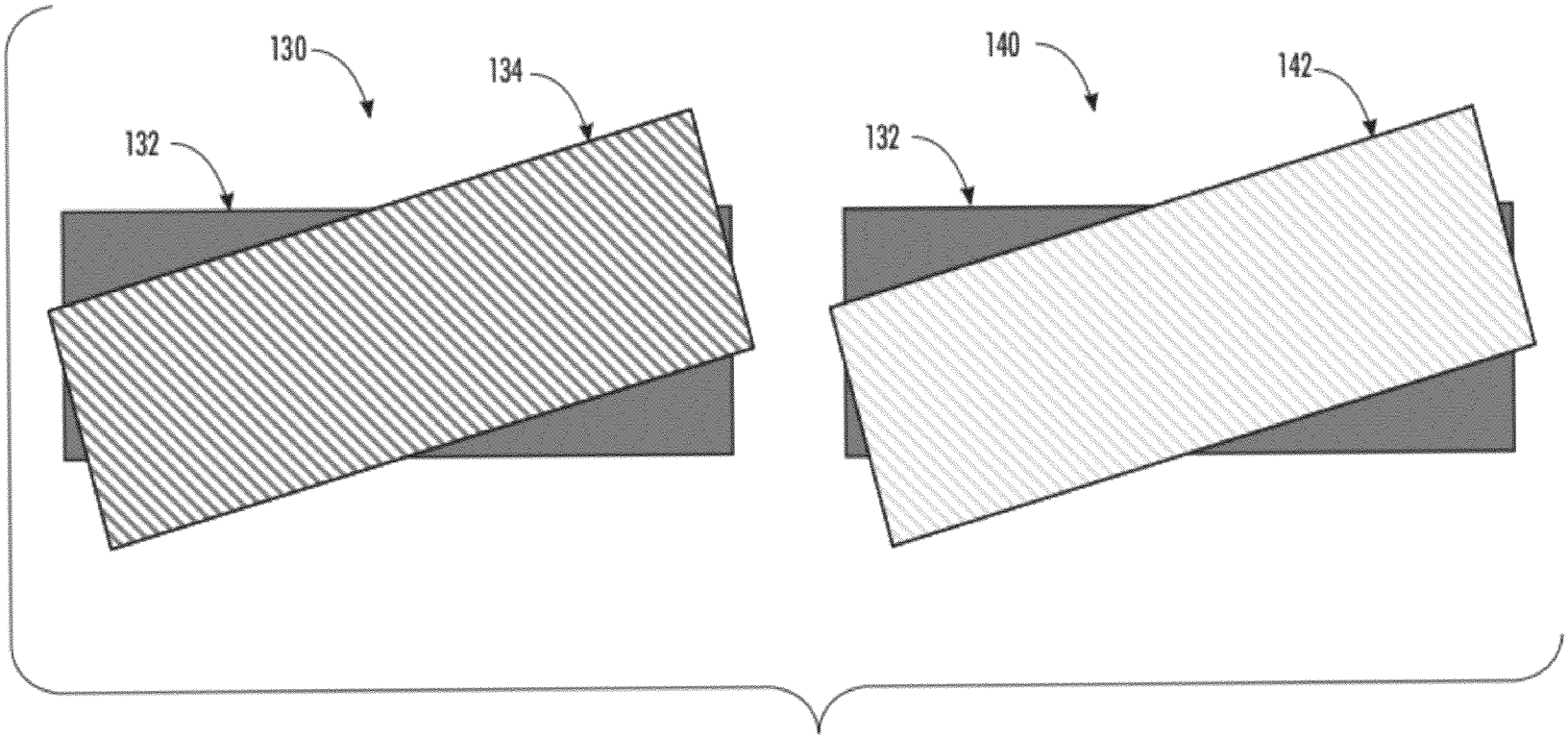
FIG. 5 illustrates two color interference overlays, such as may be printed on the inner and outer bodies (respectively) of the packages described herein.

In order for two overlaying images or interference patterns to create an effective interference effect, they are printed in a manner to satisfy certain properties. FIG. 5 is an illustration of these properties. In the spatial domain, the interference patterns comprise locally quasi-periodic patterns of high contrast and high spatial frequency. In the optical spectral domain, the overlapping signals exhibit sufficient overlap in their spectral absorption bands. In FIG. 5, the overlay 130 has two patterns 132, 134 of an identical color, thus having significant spectral overlap. The checkerboard interference pattern is readily visible, and thus the two patterns 132 and 134 would be suitable choices for the inner and outer bodies respectively of the package. The overlay 140 has a first interference patterns 132 as in the overlay 130, but the overlaid interference pattern 142 is of a different color thereby imparting negligible spectral overlap, and the yellow signal of the pattern 142 exhibits low luminance contrast; thus there is no visible interference. Thus the two patterns 132 and 142 would not create a desirable effect when moving the outer sleeve with respect to the inner body of the package.

Figure 6:
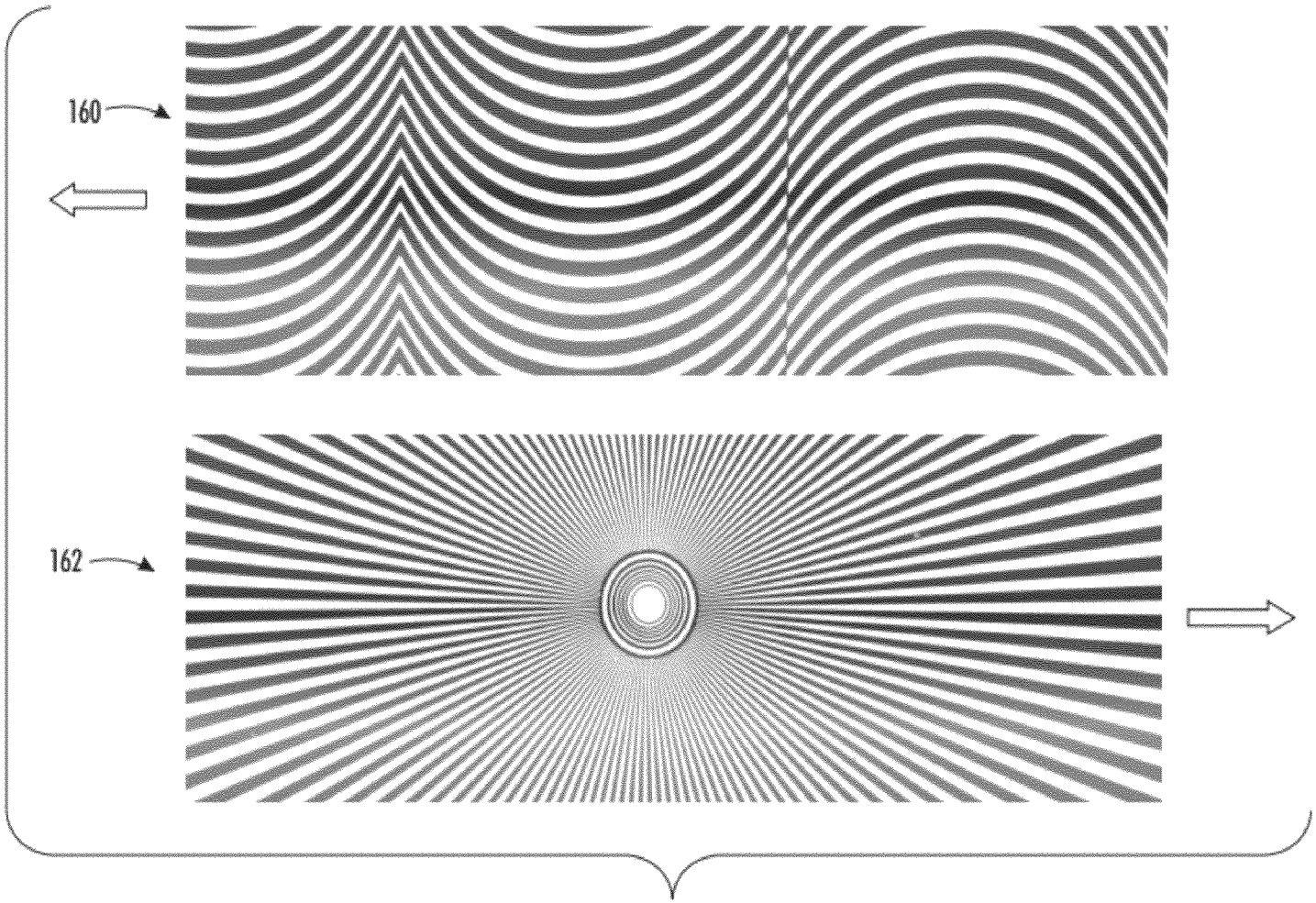
FIG. 6 illustrates a first interfering color pattern and a second interfering color pattern that may be printed on respective first and second interfering regions of a package, as described with regard to various aspects.

FIG. 6 illustrates a first quasi-periodic interfering non-neutral (color) pattern 150 and a second quasi-periodic interfering non-neutral pattern 152 that may be printed on respective first and second interfering regions of a package, as described with regard to various aspects. In order to create effective dynamic interference patterns for the packaging application, the colors on the first interfering region and colors on the semi-transparent second interfering region have sufficient spectral overlap at the spatial locations where the two surfaces are overlaid. This condition is satisfied for the entire course of the sliding motion. FIG. 6 thus shows an example of two images or patterns that satisfy the above conditions and produce a visually compelling interference effect during the sliding motion.

Figure 7:
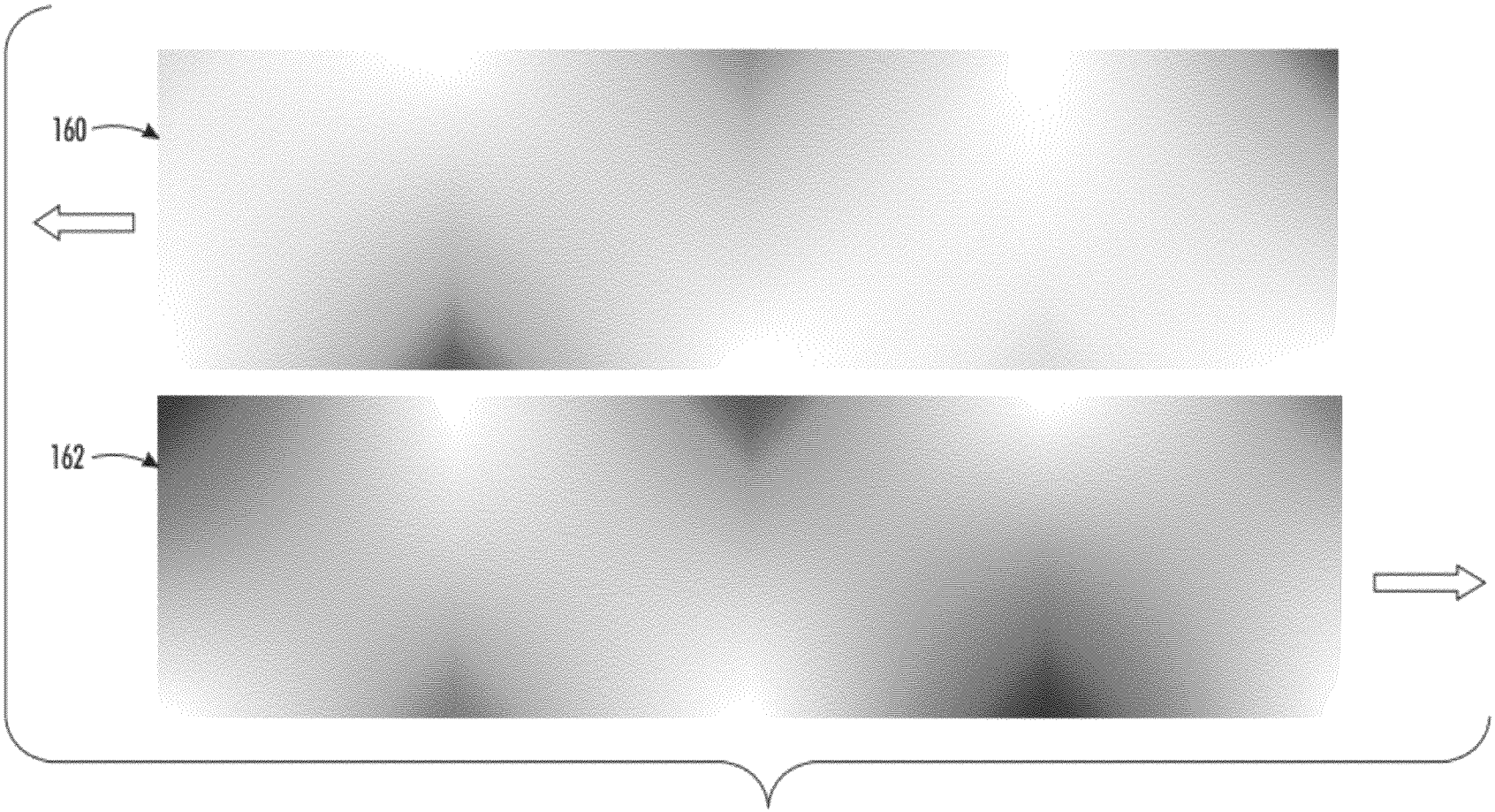
FIG. 7 illustrates a first interfering color pattern and a second interfering color pattern that, when slid over the first color pattern, creates a slowly varying color pattern.

FIG. 7 illustrates a first smoothly-varying interfering color pattern 160 and a second smoothly varying interfering color pattern 162 that, when slid over the first color pattern 160, creates a slowly varying color interference effect. The multiplicative effect of such reflectance patterns on the first and second interfering regions are employed to produce a wide range of hues during the sliding motion. In this case, when the two patterns are perfectly registered on top of each other (as shown), we have an overlap of complementary colors (e.g. red over cyan, green over magenta, etc.), and the result is a quasi-monochrome pattern varying smoothly between white and black. During the sliding motion, a kaleidoscope of colors is revealed from different multiplicative combinations of C, M, Y, R, G, B at different spatial locations.

In one example, corresponding points on the first and second interfering patterns contain complementary colors, such that when the patterns are aligned and completely overlapping (e.g., when the package is closed, the package appears to be gray and/or white. As the package is opened or closed (e.g., as the interfering patterns slide past each other), colors appear and change.

The concepts described with regard to FIGS. 5-7 can be combined; i.e. a high-contrast high-frequency quasi-periodic pattern can be superimposed on a smoothly varying color background to form an opaque image when the interfering regions are in a motionless state. The semi-transparent image can be designed likewise. During the act of sliding, interference patterns appear against a slowly varying colored background. In another example, the interference pattern printed on the outer body interference region is printed in monochromatic color or black, and the inner body interference pattern (e.g., the background pattern) is colored as shown with regard to FIG. 5-8.

Figure 8:
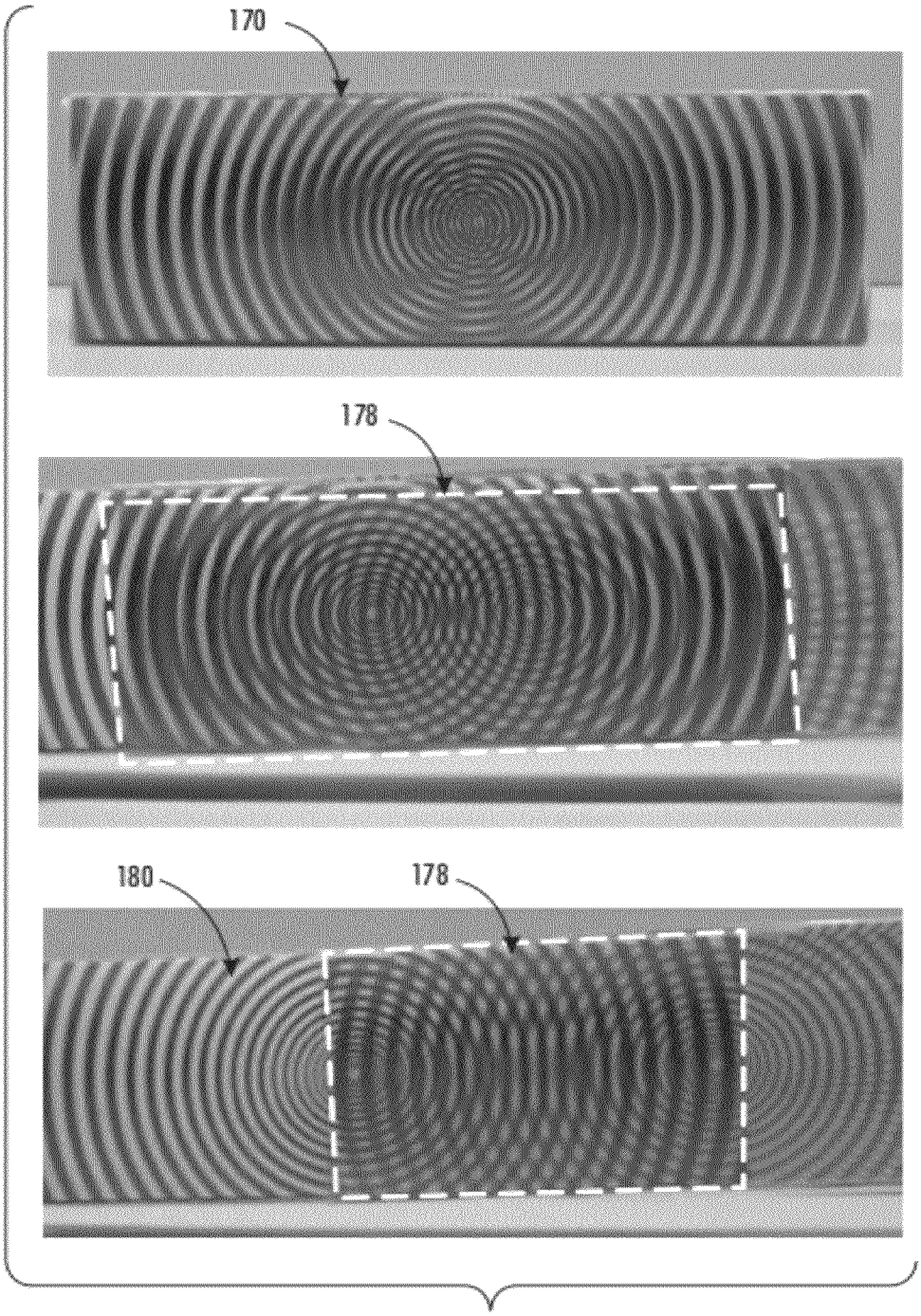
FIG. 8 illustrates a package as described herein in varying stages of opening.

FIG. 8 illustrates a package 170 as described herein in varying stages of opening. At 172, the package 170 is closed, and the interfering regions of the inner and outer bodies are aligned such that the entire package surface exhibits an interference effect or image. At 174, the package 170 is slightly open, and the interference effect 178 is seen where the first interference pattern 180 overlaps with the second interference pattern 182. At 176, the package is further opened, and the interference effect 178 is seen where the first interference pattern 180 overlaps with the second interference pattern 182. As can be seen in the figure, the interference effects are different at each stage of opening due to the different positions of the outer body interfering region relative to the inner body interfering region. It will be appreciated that the interference effect changes continually as the interfering regions are slid past each other.

Figure 9:
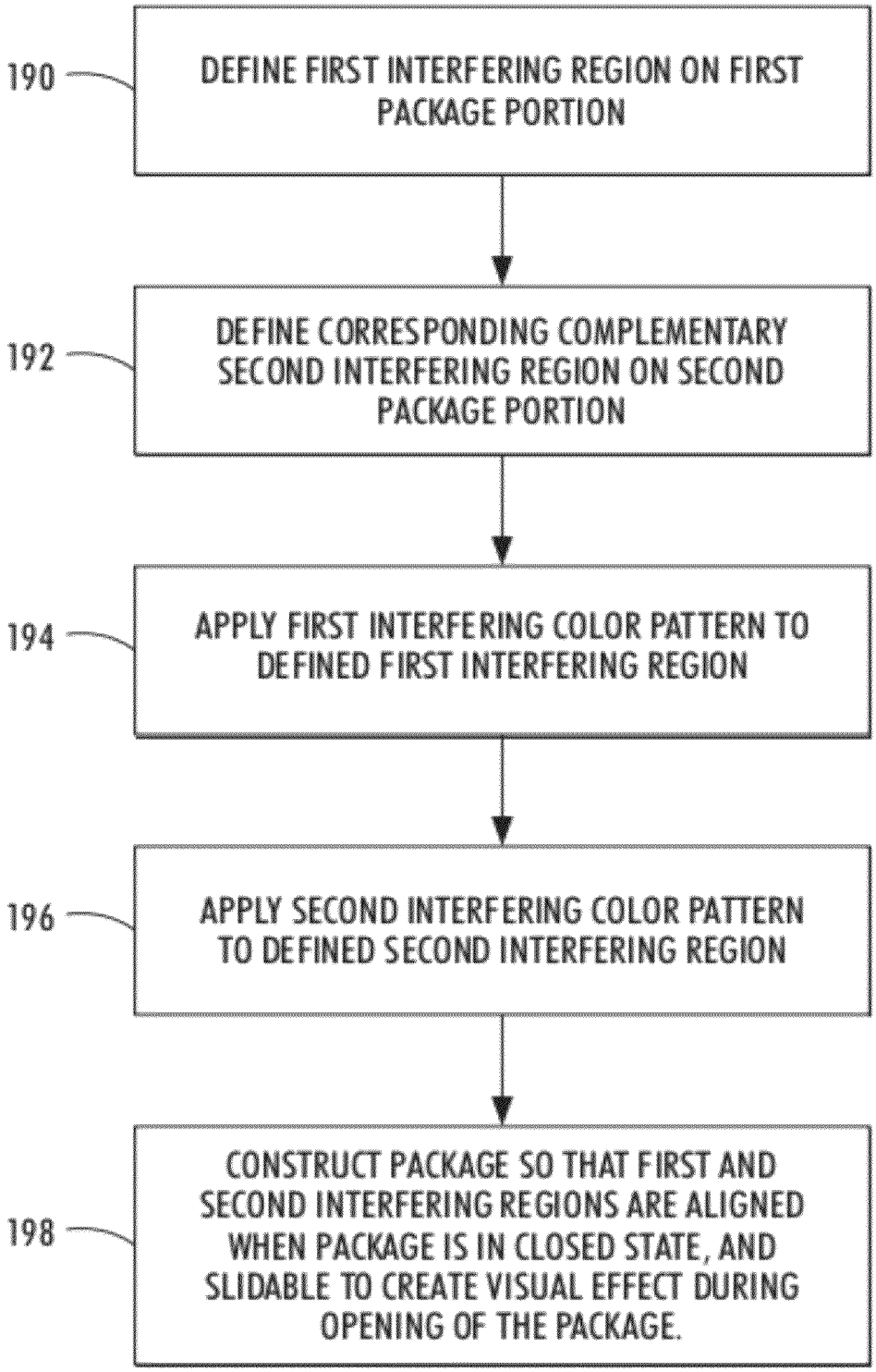
FIG. 9 illustrates a flow diagram for a method of providing an interactive visual display for a user upon the user interacting with a package on which the visual display is presented.

FIG. 9 illustrates a flow diagram for a method of providing an interactive visual display for a user upon the user interacting with a package on which the visual display is presented. At 190, a first interfering region on a first package portion is defined. At 192, a second interfering region is defined on a second package portion. The first and second package portions may be separate (e.g., a tube and sleeve as shown in FIGS. 1, 2, and 8) or may be distinct portions of a single package body (e.g., the boxes shown in FIGS. 3 and 4).

At 194, a first color interfering pattern is applied to or generated on the first package portion in the first interfering region. At 196, a second interfering color pattern is applied to or generated on the second package portion in the second interfering region. In one embodiment, the interfering patters may be printed using a DC8000 device manufactured by XEROX™ or the like. Additionally or alternatively, die lines used to generate the interference patterns package portions may be cut on a plotter-cutter device, such as is manufactured by Graphtec or the like.

At 198, a package is constructed so that the first and second interfering color regions are aligned when the package is closed, and such that the first and second interfering color regions slide past each other during opening or closing of the package to create an interactive visual effect in which the interfering color patterns appear to be moving.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A package that generates a moving color interference effect during opening or closing, comprising:

a first package portion with a first interfering region on an outer surface thereof, the interfering region having a first interference pattern printed thereon;

a transparent second package portion with a second interfering region having a second interference pattern printed thereon;

wherein the first and second interfering regions are aligned when the package is closed and are slidable past each other during opening and closing of the package, thereby creating the moving color interference effect; and wherein at least one of the first and second interference patterns comprises one or more non-neutral hues.

2. The package of claim 1, wherein at least one of the first and second interference patterns is a quasi-periodic pattern with high spatial frequency and high contrast, and wherein the first and second interference patterns have overlapping spectral absorption bands.

3. The package of claim 1, wherein at least one of the first and second interference patterns is a smoothly-varying pattern, and wherein the first and second interference patterns have overlapping spectral absorption bands.

4. The package of claim 1, wherein the first package portion is tube-shaped with a closed bottom surface and an open top.

5. The package of claim 4, wherein the first package portion is cylindrical.

6. The package of claim 5, wherein the second package portion is cylindrical with a closed top surface and an open bottom, and wherein the second package portion is slidable over the first package portion to close the package.

7. The package of claim 4, wherein the first package portion comprises three or more sides coupled to the closed bottom surface.

8. The package of claim 7, wherein the second package portion has the same number of sides as the first package portion, a closed top surface, and an open bottom, and wherein the second package portion is slidable over the first package portion to close the package.

9. The package of claim 4, wherein the second package portion is tube-shaped with a closed top surface and an open bottom, and wherein the second package portion is slidable over the first package portion to close the package.

10. The package of claim 1, wherein the first and second interfering regions extend over the entire first and second package portions, respectively.

11. The package of claim 1, wherein the first interfering region covers less than all of the first package portion, and wherein the second interfering region comprises a transparent window on which the second interference pattern is printed.

12. A method of generating a visible moving color interference effect during opening and closing of a package, comprising:

defining a first interfering region on a first package portion;

defining a second interfering region on a second package portion that mates with the first package portion to form the package;

applying a first interference pattern to the first interfering region;

applying a second interference pattern to the second interference region; and mating the second package portion to the first package portion to form the package;

wherein the first and second interference regions are aligned and overlapping when the package is in a closed state and are slidable relative to each other and create a color interference effect when the interfering regions slide past each other during opening or closing of the package; and wherein at least one of the first and second interference patterns comprises one or more non-neutral hues.

13. The method of claim 12, wherein at least one of the first and second interference patterns is a quasi-periodic pattern with high spatial frequency and high contrast, and wherein the first and second interference patterns have overlapping spectral absorption bands.

14. The method of claim 12, wherein at least one of the first and second interference patterns is a smoothly-varying pattern, and wherein the first and second interference patterns have overlapping spectral absorption bands.

15. The method of claim 12, wherein the first package portion is tube-shaped with a closed bottom surface and an open top.

16. The method of claim 15, wherein the first package portion is cylindrical, and wherein the second package portion is cylindrical with a closed top surface and an open bottom, and wherein the second package portion is slidable over the first package portion to close the package.

17. The method of claim 15, wherein the first package portion comprises three or more sides coupled to the closed bottom surface, and wherein the second package portion has the same number of sides as the first package portion, a closed top surface, and an open bottom, and wherein the second package portion is slidable over the first package portion to close the package.

18. The method of claim 15, wherein the second package portion is tube-shaped with a closed top surface and an open bottom, and wherein the second package portion is slidable over the first package portion to close the package.

19. The method of claim 12, wherein the first and second interfering regions extend over the entire first and second package portions, respectively.

20. The method of claim 12, wherein the first interfering region covers less than all of the first package portion, and wherein the second interfering region comprises a transparent window on which the second interference pattern is printed.

* * * * *